US012247175B2

(12) United States Patent
Park et al.

(10) Patent No.: US 12,247,175 B2
(45) Date of Patent: Mar. 11, 2025

(54) METHOD FOR UPGRADING HEAVY OIL BY PYROLYSIS USING BYPRODUCTS OF COKE PRODUCTION

(71) Applicants: KOREA RESEARCH INSTITUTE OF CHEMICAL TECHNOLOGY, Daejeon (KR); RESEARCH INSTITUTE OF INDUSTRIAL SCIENCE & TECHNOLOGY, Pohang-si (KR)

(72) Inventors: Sunyoung Park, Daejeon (KR); Pill Won Seo, Daejeon (KR); Ki Hyuk Kang, Daejeon (KR); Narae Kang, Daejeon (KR); Gyoo Tae Kim, Daejeon (KR); Chi Woong Ahn, Daejeon (KR); Joon Woo Kim, Gwangyang-si (KR); Dong Jun Koh, Pohang-si (KR)

(73) Assignees: KOREA RESEARCH INSTITUTE OF CHEMICAL TECHNOLOGY, Daejeon (KR); RESEARCH INSTITUTE OF INDUSTRIAL SCIENCE & TECHNOLOGY, Pohang-si (KR)

( * ) Notice: Subject to any disclaimer, the term of this patent is extended or adjusted under 35 U.S.C. 154(b) by 111 days.

(21) Appl. No.: 18/026,897

(22) PCT Filed: Aug. 25, 2021

(86) PCT No.: PCT/KR2021/011354
§ 371 (c)(1),
(2) Date: Mar. 17, 2023

(87) PCT Pub. No.: WO2022/059954
PCT Pub. Date: Mar. 24, 2022

(65) Prior Publication Data

US 2023/0332055 A1 Oct. 19, 2023

(30) Foreign Application Priority Data

Sep. 17, 2020 (KR) ..... 10-2020-0119742

(51) Int. Cl.
*C10G 9/00* (2006.01)
*C10G 55/04* (2006.01)

(52) U.S. Cl.
CPC ..... *C10G 9/00* (2013.01); *C10G 55/04* (2013.01); *C10G 2300/1077* (2013.01); *C10G 2300/206* (2013.01); *C10G 2300/301* (2013.01); *C10G 2300/80* (2013.01)

(58) Field of Classification Search
CPC .. C10G 9/00; C10G 55/04; C10G 2300/1077; C10G 2300/206; C10G 2300/301; C10G 2300/80; C10G 1/02; C10G 21/00; C10G 53/02; C10G 75/00; C10G 21/003; C10G 2300/4006; C10G 2300/4012; C10G 2400/02; C10B 53/08
See application file for complete search history.

(56) References Cited

U.S. PATENT DOCUMENTS

2012/0298552 A1* 11/2012 Koseoglu ..... C10B 57/06 208/95
2017/0335199 A1* 11/2017 Iqbal ..... C10B 57/045

FOREIGN PATENT DOCUMENTS

| | | |
|---|---|---|
| JP | S58-049785 | 3/1983 |
| JP | S58-149985 | 9/1983 |
| JP | H08-157830 | 6/1996 |
| KR | 2009-0116377 | 11/2009 |
| KR | 10-1568615 | 11/2015 |

* cited by examiner

*Primary Examiner* — Randy Boyer
*Assistant Examiner* — Juan C Valencia
(74) *Attorney, Agent, or Firm* — LEX IP MEISTER, PLLC

(57) ABSTRACT

The present invention relates to a method for upgrading heavy oil by using byproducts of coke production, and particularly provides a method for upgrading heavy oil comprising the steps of: a) mixing heavy oil with byproducts of coke production to produce a mixed liquid: and b) subjecting the mixed liquid to pyrolysis, the method allowing reduction of the amount of coke generated and thus being economical and effective.

9 Claims, No Drawings

METHOD FOR UPGRADING HEAVY OIL BY PYROLYSIS USING BYPRODUCTS OF COKE PRODUCTION

TECHNICAL FIELD

The present invention relates to a method for upgrading heavy oil by pyrolysis using byproducts of coke production, and more particularly, to a method for converting low-grade heavy oil into high-value hydrocarbon oil while delaying and reducing coke production.

BACKGROUND ART

Recently, a proportion of heavy oil in crude oil produced has increased. Therefore, there is a continuing need for technology development for producing higher value-added hydrocarbon oils by upgrading heavy oil generated during a crude oil refining process.

As a representative example of such heavy oil, vacuum residue may be mentioned. Low-grade heavy oil, such as vacuum residue, has a high content of nickel, vanadium, sulfur, nitrogen compounds, and residual carbon (conradson carbon residue), so there is a limit to upgrading.

Examples of methods for upgrading heavy oil mainly include a thermal cracking process, a fluid catalytic cracking process, and a hydrocracking process. The thermal cracking process has an advantage of being able to process low-grade heavy oil with a high content of residual carbon, metals, sulfur, and nitrogen compounds compared to other processes using catalysts, but has a disadvantage in that there is no method of controlling a large amount of coke generated. In addition, the amount of coke generated in the thermal cracking process is proportional to the heavier of the feed used, and therefore, when the yield of light oil is considered, there are restrictions on oil that may be economically processed.

The fluid catalytic cracking process is currently widely used, but since it uses a zeolite-based catalyst, the restriction on the oil that may be treated is greater than that of other processes. In addition, the hydrocracking process may obtain a higher conversion rate than other processes, but has limitations associated with harsh operating conditions such as high temperature and pressure. The hydrodesulfurization process also has a problem in that the usable oil is limited because the amount of coke generated increases as the treated oil is heavier, which causes catalyst inactivation and process line/valve fouling.

According to limitations such as shortening the life span due to catalyst deactivation due to coke generation in the processes for treating heavy oil as described above, problems in controlling process conditions, and lowering the yield of light products, there is a need for a technology capable of effectively treating heavy oil while inhibiting the generation of coke.

Therefore, there is a need to develop an additive capable of effectively operating at a lower hydrogen partial pressure than in the prior art in a process of upgrading heavy oil or inducing a reduction in coke generation in the thermal cracking process.

Korean Patent Registration No. 10-1568615 is a technology using an additive as a hydrogen donor, but uses an expensive supercritical or subcritical tetralin solvent, so there is a limitation in terms of economics and there is a problem that an additional separation and purification process at a rear stage for subsequent recovery is required. In addition, since the hydrogen donor content of 10 to 400 parts by weight is suggested with respect to 100 parts by weight of the oil to be treated, there is a limit in that a size of a reactor needs to be increased because a capacity to be treated in the reactor increases.

Therefore, there is a need for an additive that may secure economic feasibility, does not cause a change in product properties, does not require an additional separation process, and may not burden the reactor with a small amount of use.

DISCLOSURE

Technical Problem

Therefore, the present inventors of the present invention, focusing on the fact that it is possible to secure economic feasibility and not require an additional separation process when using low-cost materials with low utilization as additives, such as process byproducts, devised the present invention related to a method for efficiently upgrading through pyrolysis of low-grade heavy oil using byproducts generated in a coke producing process.

An object of the present invention is to provide a method for upgrading heavy oil without the burden of reactor treatment capacity by using a small amount of byproducts generated in the coke producing process.

Another object of the present invention is to provide a method for upgrading by pyrolysis of heavy oil, which has a remarkably excellent coke reduction effect, by using byproducts generated in the process for producing coke as additives.

Technical Solution

In one general aspect, there is provided a method for upgrading heavy oil using byproducts of coke production, the method comprising:

a) mixing heavy oil with byproducts of coke production to produce a mixed liquid; and b) subjecting the mixed liquid to pyrolysis.

The byproducts of the coke production may be a liquid.

The step b) may be carried out under conditions of 300 to 500° C. and normal pressure to 80 bar.

The step b) may be carried out in an inert gas atmosphere.

The byproducts of the coke production are liquid byproducts generated in producing lump coke, wherein the producing of the lump coke may include: preparing raw coal by crushing and drying coal; and producing lump coke by carbonizing the raw coal at 800 to 1300° C.

The liquid byproducts may include oil having a boiling point of 130 to 600° C.

The heavy oil may be any one or two or more selected from the group consisting of oil sand, bitumen, heavy oil, extra heavy oil, vacuum residue, atmospheric residue, pyrolyzed fuel oil (PFO), fluid catalytic cracking decant oil (FCC-DO), and ethylene bottle oil (EBO).

The byproducts of the coke production may include 0.1 to 20 parts by weight based on 100 parts by weight of the heavy oil.

The heavy oil may have a hydrocarbon oil content of 30% or more having a boiling point of 500° C. or more.

The method may further include a pretreatment step of solvent deasphalting of the heavy oil before the step a).

Advantageous Effects

The method for upgrading heavy oil according to the present invention may reduce the amount of coke produced by delaying coke production by providing byproducts of the coke production as an additive in a thermal cracking reaction of heavy oil.

The method for upgrading heavy oil according to the present invention may exhibit a high liquid yield and an effect of inhibiting the formation of asphaltenes and coke.

Even if the effect is not explicitly mentioned in the present invention, the effects described in the specification expected by technical features of the present invention and the inherent effects thereof, are treated as described in the specification of the present invention.

BEST MODE

As used herein, technical terms and scientific terms have the general meanings understood by those skilled in the art to which the present invention pertains unless otherwise defined, and a description for the known function and configuration unnecessarily obscuring the gist of the present invention will be omitted in the following description and the accompanying drawings.

Further, singular forms used herein are intended to include the plural forms as well unless otherwise indicated in context.

In addition, units used herein are based on weight, unless otherwise specified. For example, the unit of % or ratio means % by weight or ratio by weight, and % by weight means % by weight of any one component in the total composition, unless otherwise defined.

In addition, numerical ranges used herein include a lower limit, an upper limit, and all values within that range, increments that are logically derived from the type and width of the defined range, all double-defined values, and all possible combinations of upper and lower limits of numerical ranges defined in different forms. Unless otherwise defined herein, values outside the numerical range that may arise due to experimental errors or rounded values are also included in the defined numerical range.

As used herein, the term "comprise" is an "open" description having the meaning equivalent to expressions such as "include," "contain," "have," or "feature", and does not exclude elements, materials, or process that are not further listed.

Hereinafter, a "conversion rate" as used herein refers to a ratio of the total amount of liquid products, gas products, and cokes based on the total weight of the product when the thermal cracking reaction of heavy oil is carried out. Here, the total product refers to the total weight of gas products, liquid products, residues, and cokes.

A "liquid yield" as used herein refers to the ratio of the total amount of liquid products based on the total weight of the product weight when the thermal cracking reaction of heavy oil is carried out. Here, the liquid products may be, for example, naphtha, middle distillates, and gas oil.

A "coke" as used herein is composed of hydrocarbons and refers to major byproducts of the thermal cracking reaction that no longer decomposes into light oil. The coke is a byproduct that not only lowers a liquid yield of the thermal cracking reaction, but also may cause serious problems in operation during a unit process by being deposited on the walls of reactors or transport pipes used in a unit process.

The present invention provides a method for upgrading heavy oil using byproducts of coke production, the method including: a) mixing heavy oil with byproducts of coke production to produce a mixed liquid; and b) subjecting the mixed liquid to pyrolysis.

The heavy oil meant in the present invention may be any one or two or more selected from the group consisting of oil sand, bitumen, heavy oil, extra heavy oil, vacuum residue, atmospheric residue, pyrolyzed fuel oil (PFO), fluid catalytic cracking decant oil (FCC-DO), and ethylene bottle oil (EBO), but any petroleum-based residue oil may be used without limitation thereto.

The heavy oil may have a hydrocarbon oil content of 30% or more having a boiling point of 500° C. or more. In addition, the heavy oil contains a large amount of impurities such as micro carbon residue (MCR), metals, nitrogen, sulfur, and asphaltenes, and upgrading of the heavy oil means modifying it with hydrocarbons having a low-boiling point with high added value.

The step a) is mixing the heavy oil and the byproducts of coke production, which is an additive, and may be carried out at room temperature and normal pressure. Here, it may be advantageous to efficiently achieve the effect of reducing coke and increase an upgrading conversion rate of the heavy oil when the byproducts of coke production are included in an amount of 0.1 to 20 parts by weight, preferably 0.5 to 20 parts by weight, and more preferably 5 to 15 parts by weight, based on 100 parts by weight of the heavy oil.

The byproducts of coke production are generated in the coke producing process such as the steel industry, and may be liquid. In other words, by directly using liquid byproducts generated in coke producing process as additives, excellent mixing with heavy oil powder and solvent is not required, and thus an additional separation and purification process at a rear stage for solvent recovery after the upgrading process is not required.

Specifically, the coke producing process may include: preparing raw coal by crushing and drying coal; and producing lump coke by carbonizing the raw coal at 800 to 1300° C.

The byproducts of coke production may be liquid byproducts generated in a production step of the lump coke.

The liquid byproducts may include oil having a boiling point of 130 to 600° C. Specifically, a ratio of aromatic hydrocarbons may range from 70 to 100%, and preferably from 80 to 95%. A ratio of saturates may be 0 to 5%, and preferably 0 to 1%. A ratio of resins may be 0 to 25%, and preferably 5 to 20%.

In addition, a ratio of the compound having a boiling point distribution of 200 to 400° C. in the liquid byproducts may be 70 to 100%, and preferably 80 to 98%. The content of aromatic hydrogen in the liquid byproducts may be in the range of 65 to 95%, and preferably 70 to 85%.

Step b) is a step of performing a thermal cracking reaction on the liquid mixture prepared in step a), and does not require hydrogen gas or a catalyst, and may convert high-boiling components in heavy oil into hydrocarbons having a low-boiling point and with high added value. Here, some of the high boiling point components in the heavy oil are converted to coke, which is byproduct of pyrolysis, and the amount of coke generated is directly related to the amount of the hydrocarbon oil generated having a low boiling point. Since the present invention proceeds with the thermal cracking reaction using the byproducts of coke production as an additive, the generation of coke may be significantly reduced.

The thermal cracking reaction may be carried out at 300 to 500° C., preferably 350 to 500° C., and more preferably 400 to 500° C., and the pressure may be from normal pressure to 80 bar. Specifically, the thermal cracking reaction may be carried out in an inert gas atmosphere for 30 minutes to 5 hours, and preferably 30 minutes to 4 hours, and may be carried out in a nitrogen or argon atmosphere as a non-limiting example.

In an exemplary embodiment according to the present invention, the thermal cracking reaction may be carried out by injecting nitrogen gas at room temperature for 5 to 10 minutes into a mixture produced by mixing heavy oil and byproducts of coke production in a reactor, raising the temperature of the reactor to 300 to 500° C., and then reacting the mixture for 30 minutes to 3 hours at a stirring speed of 100 to 2000 rpm. Here, the reactor may be a batch reactor or a flow reactor, but a batch reactor may be used in terms of minimizing the change in conversion rate and coke production according to an operation method.

In the method for upgrading the heavy oil according to the present invention, a pretreatment step of solvent deasphalting the heavy oil may be further included, before mixing the heavy oil with the byproducts of coke production in the step a). Since a large amount of asphaltene components included in the heavy oil are accumulated inside a reactor or a transport line due to agglomeration during a treatment process and cause problems in the process, including the pretreatment step has an effect of preventing aggregation between asphaltenes.

Specifically, solvent deasphalting is an artificial precipitation of asphaltenes by dissolving them in a hydrocarbon solvent. The hydrocarbon solvent may be a normal alkane-based hydrocarbon solvent or an aromatic hydrocarbon solvent. Preferably, a normal paraffin-based solvent is good because it increases dispersibility of asphaltenes in the heavy oil and thus has an excellent effect of preventing aggregation between asphaltenes.

Hereinafter, the method for upgrading the heavy oil according to the present invention will be described in more detail with reference to the Examples. The following Examples are only a reference for describing the present invention in detail, and the present invention is not limited thereto and may be implemented in various forms.

Example 1

Reactants were prepared by introducing 40 g of vacuum residue (VR) from Hyundai Oilbank having the same characteristics as shown in Table 1 and 5 g of byproducts of coke production into a 250 ml batch reactor (Parr Instrument). After repeating nitrogen purging in the reactor three times, a reaction temperature was raised to 430° C., and the vacuum residue was subjected to a thermal cracking reaction for 30 minutes at a stirring speed of 1500 rpm.

TABLE 1

| Division | Components | Content |
|---|---|---|
| Elemental analysis | C | 83.7 wt % |
| | H | 10.1 wt % |
| | N | 0. 6 wt % |
| | S | 5.6 wt % |
| Heavy metal component analysis | Ni | 72.3 wppm |
| | V | 309.1 wppm |
| SARA analysis | Saturates | 5.0 wt % |
| | Aromatics | 51.8 wt % |
| | Resins | 24.8 wt % |
| | Asphaltenes | 18.4 wt % |
| | Total | 100 wt % |
| API | — | 5.8° |
| Distillation Curve | >524° C. | 78.5 wt % |
| Conradson carbon residue (CCR) | — | 23.3 wt % |

Example 2

Example 2 was carried out in the same manner as in Example 1, except that 2 g of the byproducts of coke production was added instead of 5 g.

Example 3

Example 3 was carried out in the same manner as in Example 1, except that 0.5 g of the byproducts of coke production was added instead of 5 g.

Example 4

Example 4 was carried out in the same manner as in Example 1, except that 0.25 g of the byproducts of coke production was added instead of 5 g.

Comparative Example 1

Comparative Example 1 was carried out in the same manner as in Example 1, except that the byproducts of coke production were not added.

Comparative Example 2

Comparative Example 2 was carried out in the same manner as in Example 2, except that 2 g of tetralin was added instead of 2 g of the byproducts of coke production.

Experimental Examples: Thermal Cracking Performance Evaluation of Vacuum Residue When the thermal cracking reactions according to Examples 1 to 4 and Comparative Examples 1 and 2 were completed, rapid cooling to room temperature was carried out through a cooling coil, the gas product was collected in a tedlar bag and analyzed by gas chromatography equipped with TCD and FID, and the liquid product and coke were separated and quantified according to a difference in solubility in toluene. The properties and results of the product properties are shown in Tables 2 and 3 below.

TABLE 2

| Division | Vacuum residue (g) | Reaction temperature (° C.) | Reaction time (hr) | Additive (g) | [additive (g)/(vacuum residue (g) + additive (g))] * 100% (wt %)] |
|---|---|---|---|---|---|
| Example 1 | 40 | 430 | 0.5 | 5 | 11.1 |
| Example 2 | 40 | 430 | 0.5 | 2 | 4.8 |
| Example 3 | 40 | 430 | 0.5 | 0.5 | 1.2 |
| Example 4 | 40 | 430 | 0.5 | 0.25 | 0.6 |
| Comp. Example 1 | 40 | 430 | 0.5 | — | — |
| Comp. Example 2 | 40 | 430 | 0.5 | 2 | 4.8 |

TABLE 3

| Product distribution | Example 1 | Example 2 | Example 3 | Example 4 | Comp. Example 1 | Example 2 Comp. |
|---|---|---|---|---|---|---|
| Gas yield (wt %) | 10.8 | 10.6 | 11.0 | 13.4 | 8.5 | 14.1 |
| Liquid yield (wt %) | 64.5 | 63.3 | 59.1 | 56.0 | 57.3 | 45.8 |
| Coke yield (wt %) | 10.9 | 11.9 | 15.4 | 17.1 | 20.0 | 13.5 |
| +524° C. conversion rate (wt %) | 81.8 | 81.3 | 81.0 | 82.2 | 81.3 | 65.0 |
| Asphaltene conversion rate (wt %) | 56.2 | 57.6 | 62.7 | 63.6 | 65.3 | 61.5 |
| Asphaltene + coke yield (wt %) | 18.9 | 19.7 | 22.2 | 23.8 | 26.4 | 20.5 |

As can be seen in Table 3, it can be confirmed that in the case of Example 1 using 11.1 wt % of byproducts of coke production as an additive, the coke yield was 10.9 wt %, and the coke production reduced by almost 50% compared to Comparative Example 1 in which the thermal cracking reaction was carried out without an additive. In addition, since the amount of coke produced decreases as the content of the byproducts of coke production increases, the coke-reducing effect tended to depend on the concentration of the byproducts of coke production, which are additives.

In addition, it can be confirmed that as in Example 4, even with a very small amount of byproducts of coke production of 0.6 wt %, an inhibitory effect on coke formation was shown in the thermal cracking reaction, and the effect of the byproducts for coke production according to the present invention as an additive for delaying coke production was very excellent.

In addition, it can be confirmed that the coke yield in Comparative Example 2 using 4.8 wt % of tetralin as an additive was 13.5 wt %, which was higher than the coke yield of 11.9 wt % in Example 2 using the same amount of byproducts of production by-product as an additive, and the byproducts of coke production had a greater coke reduction effect as an additive in the thermal cracking reaction of vacuum residue.

Although the preferred embodiments of the present invention have been described above, the present invention is not limited thereto, and it is possible to make various modifications and practice within the scope of the claims and the description and the accompanying drawings, and this is also natural to belong to the scope of the invention.

The invention claimed is:

1. A method for upgrading heavy oil using byproducts of coke production, the method comprising:

a) mixing heavy oil with byproducts of coke production to produce a mixed liquid; and b) subjecting the mixed liquid to pyrolysis, wherein the byproducts of the coke production are liquid byproducts generated in producing lump coke, and wherein the producing of the lump coke includes:

preparing raw coal by crushing and drying coal; and producing lump coke by carbonizing the raw coal at 800 to 1300° C.

2. The method of claim 1, wherein the byproducts of the coke production is a liquid.

3. The method of claim 1, wherein the step b) is carried out under conditions of 300 to 500° C. and normal pressure to 80 bar.

4. The method of claim 3, wherein the step b) is carried out in an inert gas atmosphere.

5. The method of claim 1, wherein the liquid byproducts include oil having a boiling point of 130 to 600° C.

6. The method of claim 1, wherein the heavy oil is any one or two or more selected from the group consisting of oil sand, bitumen, heavy oil, extra heavy oil, vacuum residue, atmospheric residue, pyrolyzed fuel oil (PFO), fluid catalytic cracking decant oil (FCC-DO), and ethylene bottle oil (EBO).

7. The method of claim 1, wherein the byproducts of the coke production include 0.1 to 20 parts by weight based on 100 parts by weight of the heavy oil.

8. The method of claim 1, wherein the heavy oil has a hydrocarbon oil content of 30% or more having a boiling point of 500° C. or more.

9. The method of claim 1, further comprising a pretreatment step of solvent deasphalting of the heavy oil, before the step a).

* * * * *